United States Patent [19]

Lee

[11] 4,046,439

[45] Sept. 6, 1977

[54] CABINET FOR A FIRE EXTINGUISHER WITH LOCKING CLOSURE MEMBER

[76] Inventor: Walter Lee, 4450 W. 78th St., Bloomington, Minn. 55435

[21] Appl. No.: 653,941

[22] Filed: Jan. 30, 1976

[51] Int. Cl.[2] ..... A62C 27/16; A47B 96/06; B65D 25/54

[52] U.S. Cl. ..... 312/138 R; 312/290; 312/245; 248/203; 169/51

[58] Field of Search ..... 312/138 R, 100, 290, 312/219, 216, 245; 248/203; 169/51

[56] References Cited

U.S. PATENT DOCUMENTS

| | | | |
|---|---|---|---|
| 1,090,752 | 3/1914 | Quackenbush | 312/290 |
| 1,186,642 | 6/1916 | Alamy | 312/138 R |
| 1,458,848 | 6/1923 | Ploplis | 312/290 |
| 2,420,125 | 5/1947 | Crist | 248/203 |
| 2,505,898 | 5/1950 | Jaffe et al. | 312/290 |
| 2,532,083 | 11/1950 | Brenner | 312/138 R |
| 3,146,739 | 9/1964 | Furman | 312/245 |
| 3,297,376 | 1/1967 | Barstow | 312/219 |
| 3,736,035 | 5/1973 | Brown et al. | 312/138 R |
| 3,942,669 | 3/1976 | Savage, Jr. | 169/51 |

*Primary Examiner*—Paul R. Gilliam
*Assistant Examiner*—Victor N. Sakran
*Attorney, Agent, or Firm*—Wicks & Nemer

[57] ABSTRACT

A cabinet for housing a fire extinguisher including two sidewalls, a back wall, a bottom wall and a removable transparent partial front wall slidably mounted between said sidewalls. Channels formed by two sets of right angular flanges extending from said sidewalls provide the channel structure into which the front wall is slidably mounted. The cabinet is finished off and closed by a top closure member comprised of a flat portion and a depending flat front portion joined at a right angle. The closure member's flat top portion is slidably and removably mounted in channels formed by right angular flanges extending from the top of said sidewalls and back wall and a partial top wall spaced below said flanges. With both the partial front wall and the closure member inserted in their respective channel structures as far as possible, the depending flat portion of the closure member overlaps and meets the partial front wall thereby closing and completing the cabinet. A conventional cylinder lock is mounted in the depending flat front portion of the closure member, the rotatable latch bar of the lock engageable with a right angular flange depending from the partial top wall for locking the cabinet.

3 Claims, 4 Drawing Figures

FIG. 1
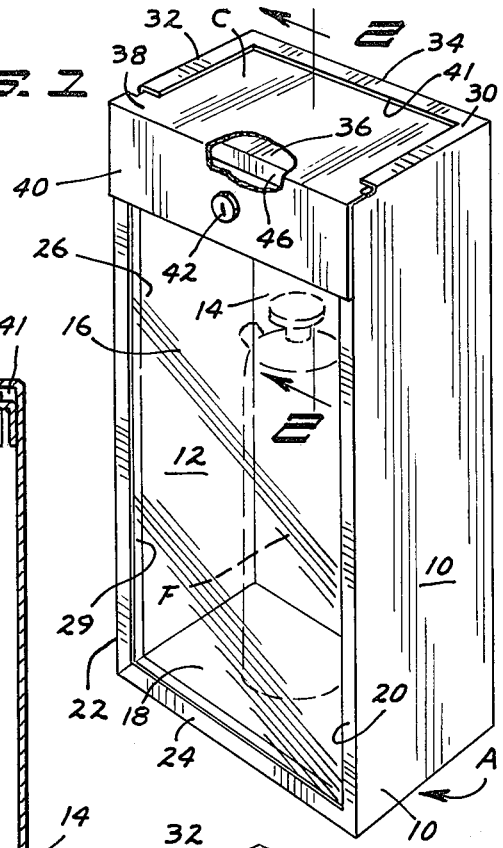
FIG. 2
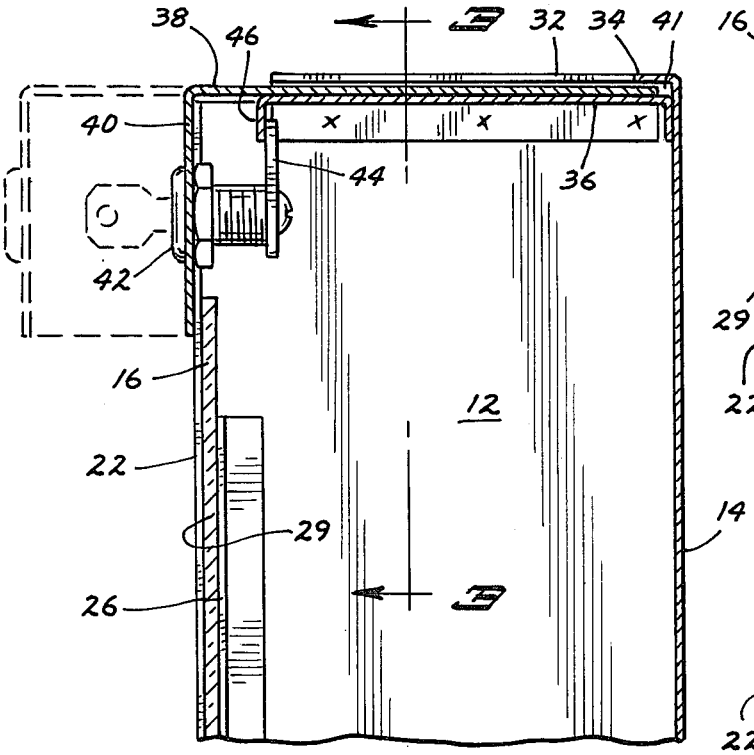
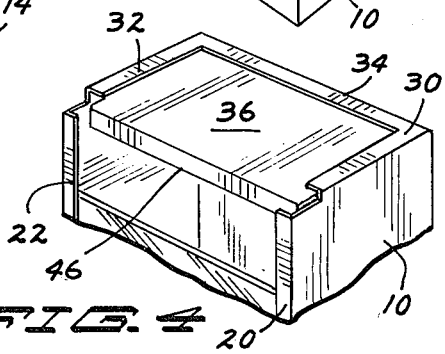
FIG. 4
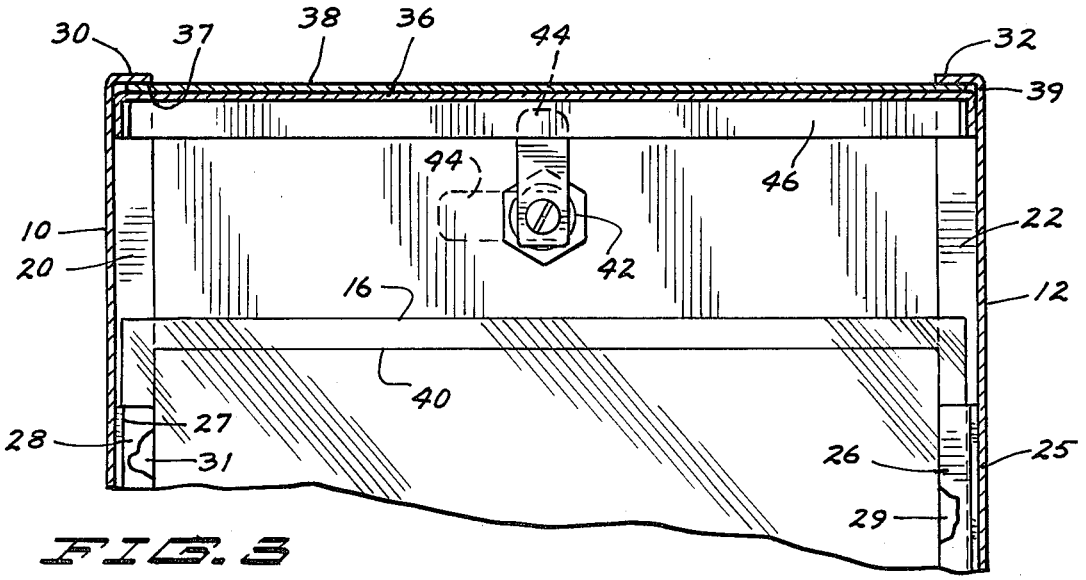
FIG. 3

CABINET FOR A FIRE EXTINGUISHER WITH LOCKING CLOSURE MEMBER

SUMMARY

The invention relates in particular to a closure structure for a cabinet for housing fire extinguishers. The closure structure employs a removable, slidably mounted, transparent, partial front wall and a removable, slidably mounted closure member comprised of a top flat portion and a depending flat portion. When both parts of the closure structure are slid into the closed position upon the cabinet the cabinet is completed.

Furthermore, the top closure member mounts a conventional locking mechanism which locks the cabinet and when locked requires anyone desiring to remove the fire extinguisher for emergency use to break the transparent partial front wall thereby deterring those who desire to reach the extinguisher for other than legitimate emergency purposes. If unlocked, however, the top closure member is easily removed and the fire extinguisher is rendered easily accessible for filling or replacement.

The device provides a lockable cabinet and deters anyone from taking the fire extinguisher unless for an emergency or vandalism in which case the partial glass wall must be broken.

The invention will appear more clearly from the following detailed description when taken in connection with the accompanying drawings, showing by way of example a preferred embodiment of the inventive idea wherein like numerals refer to like parts throughout.

In the drawings forming part of this application:

FIG. 1 is a perspective view of a cabinet for a fire extinguisher embodying the invention with the top closure member in place so as to complete the cabinet and enable one to lock the cabinet.

FIG. 2 is a sectional view on the line 2—2 of FIG. 1.

FIG. 3 is a sectional view on the line 3—3 of FIG. 2.

FIG. 4 is a perspective view of the top portion of the cabinet with the top closure member removed.

Referring to the drawings in detail, the device A includes the sidewalls 10 and 12. A back wall 14 connects the sidewalls 10 and 12. A removable, transparent, partial front wall 16 extends, as hereinafter described, between the sidewalls 10 and 12. So connected, the four walls, i.e., 10, 12, 14 and 16 form a cabinet of approximately rectangular cross section. One end of the cabinet is closed by the bottom wall 18.

The sidewalls 10 and 12 having a supporting structure represented by right angular flanges 20 and 22, respectively, which extend along the front wall 16 towards the center of the front wall. The bottom wall 18 has an upstanding right angular flange 24 which extends along the front wall towards the top of the cabinet. Inside the cabinet are two additional supporting structures represented by right angular flanges 26 and 28 which are secured to sidewalls 12 and 10 respectively. Flange 26 is spaced from flange 22 and together flanges 26 and 22 form a channel 29 and flange 28 is spaced from flange 20 thereby forming a channel 31. The channels 29 and 31 allow front wall 16 to be slipped into these channels from the top thereby forming a removable front wall and with such wall in place complete the cabinet except for the closure member C.

The sidewalls 10 and 12 have additional right angular flanges 30 and 32, respectively, which extend towards each other at the top of the cabinet. Similarly, the back wall 14 has a right angular flange 34 located at its top edge which extends toward the front wall 16. Further provided is a supporting top wall 36, recessed slightly from the front wall and spaced from the flanges 30, 32, and 34 which is connected to sidewalls 10 and 12 and back wall 14. Flanges 30, 32, and 34 then extend over the support wall 36 and together with the supporting top wall 36 forms a slotted structure or channels 37, 39, and 41 into which the flat top portion 38 of closure member C is slid.

The closure member C is comprised of two flat portions 38 and 40 right angularly connected and right angularly displaced with portion 38 sliding into the above described channels formed by the flanges 30, 32, and 34 and the supporting top wall 36. The flat portion 40 extends downward along the outer surface of flanges 20 and 22 when portion 38 is slid into channels 37, 39 and 41.

Mounted on flat portion 40 is a conventional locking mechanism 42. This mechanism employs a rotatable bar 44 which when the mechanism 42 is in the locked position will be rotated towards the supporting wall 36 such that part of the rotatable bar 44 engages the lock receiving means, i.e., flange 46, upon flange 46's inner surface. Flange 46 is right angularly connected to the front edge of supporting wall 36 and depends therefrom. With the lock bar 44 in engagement with the flange 46, the closure member C cannot be removed thereby locking the cabinet in a closed position.

In using device A, which includes closure member C, the cabinet can be completely closed by inserting the transparent front wall 16 into the channels 37, 39, and 41. Furthermore, device A can be locked by rotating bar 44 upwards such that bar 44 engages flange 46 and is between flange 46 and back wall 14. Device A can be unlocked by rotating bar 44 downwards such that bar 44 no longer engages flange 46. Once unlocked, device A can be opened by sliding closure member C outwards towards front wall 16. Once opened front wall 16 can be removed by sliding front wall 16 upwards. With closure member C removed, a fire extinguisher F enclosed in device A can be easily removed for refilling or replacement.

Having thus described the invention, what is claimed as new and desired to be secured by Letters Patent is:

1. A cabinet for a fire extinguisher and the like comprising:

a. a first sidewall,
b. a second sidewall,
c. a bottom wall, and
d. a back wall, connected to said sidewalls
e. a closure member having
f. a flat top portion having a rear edge and a front edge and
g. a flat front portion depending from the front edge,
h. a partial transparent front wall,
i. means slidably mounting said front wall between said sidewalls at the front of said cabinet,
j. means for slidably mounting said top portion of said closure member at the top of said cabinet to a position with the top portion closing off the top of the cabinet and said depending front portion overlying a portion of said front wall, and
k. a lock carried by said depending front portion of said closure member engageable with
l. means carried by said cabinet.
m. said means for slidably mounting said top portion of said closure member includes a slotted supporting structure into which said closure member is slid, and n. said slotted supporting structure includes spaced protrusions connected to said cabinet between which said top portion of said closure member slides.

2. The device of claim 1 in which said protrusions include flanges and underlying said flanges a supporting top wall connected to said cabinet.

3. The device of claim 1 in which said protrusions are flanges and a supporting top wall.

* * * * *